US008573726B2

(12) United States Patent
Mase et al.

(10) Patent No.: US 8,573,726 B2
(45) Date of Patent: Nov. 5, 2013

(54) IMAGE FORMING APPARATUS

(75) Inventors: Ryusuke Mase, Kanagawa (JP); Ichiro Komuro, Kanagawa (JP); Mamoru Yorimoto, Tokyo (JP); Shinichiro Naruse, Kanagawa (JP); Soichi Saiga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 332 days.

(21) Appl. No.: 13/027,549

(22) Filed: Feb. 15, 2011

(65) Prior Publication Data

US 2011/0199410 A1 Aug. 18, 2011

(30) Foreign Application Priority Data

Feb. 17, 2010 (JP) ..... 2010-032932

(51) Int. Cl.
*B41J 29/38* (2006.01)

(52) U.S. Cl.
USPC ..... 347/14; 347/37

(58) Field of Classification Search
CPC ..... B41J 2/165
USPC ..... 347/9, 14, 15, 19, 37
See application file for complete search history.

(56) References Cited

U.S. PATENT DOCUMENTS

| | | | |
|---|---|---|---|
| 7,841,682 | B2 | 11/2010 | Yorimoto et al. |
| 7,854,489 | B2 | 12/2010 | Hagiwara et al. |
| 2008/0225066 | A1 | 9/2008 | Yorimoto et al. |
| 2008/0225067 | A1 | 9/2008 | Morino et al. |
| 2008/0225068 | A1 | 9/2008 | Morino et al. |
| 2008/0225098 | A1 | 9/2008 | Hagiwara et al. |
| 2008/0231649 | A1 | 9/2008 | Kawabata et al. |
| 2009/0148181 | A1 | 6/2009 | Niihara et al. |
| 2009/0189937 | A1 | 7/2009 | Naruse et al. |
| 2010/0295897 | A1 | 11/2010 | Naruse et al. |

FOREIGN PATENT DOCUMENTS

| | | |
|---|---|---|
| JP | 9-109423 | 4/1997 |
| JP | 9-240097 | 9/1997 |
| JP | 2008-229917 | 10/2008 |

*Primary Examiner* — An Do
(74) *Attorney, Agent, or Firm* — Cooper & Dunham LLP

(57) ABSTRACT

An image forming apparatus including a first carriage having a first recording head to eject black liquid droplets, a second carriage having a second recording head to eject color liquid droplets and separatably dockable with the first carriage, a position detector to detect a position of the second carriage relative to the first carriage in a state in which the first and second carriages are docked with each other, and a landing position corrector to correct landing positions of liquid droplets ejected from at least one of the first and second recording heads. The landing position corrector holds the position of the second carriage obtained by the position detector as a reference position and adjusts a correction amount for correcting the landing positions based on an amount of shift between the reference position and a present position of the second carriage docked with the first carriage.

9 Claims, 16 Drawing Sheets

IMAGE FORMING APPARATUS

BACKGROUND

1. Technical Field

This disclosure relates generally to an image forming apparatus, and more particularly, to an image forming apparatus using a recording head including a liquid ejection head that ejects liquid droplets.

2. Description of the Background

One example of related-art image forming apparatuses such as printers, copiers, plotters, facsimile machines, and multifunction devices having two or more of printing, copying, plotting, and facsimile functions is an inkjet recording device employing a liquid ejection recording method. The inkjet recording device includes a recording head that ejects droplets of a recording liquid such as ink onto a sheet of a recording medium while the sheet is conveyed to form an image on the sheet.

Examples of the inkjet recording device include a serial-type image forming apparatus, in which the recording head ejects liquid droplets while moving in a main scanning direction to form an image on the sheet as the sheet is moved in a sub-scanning direction perpendicular to the main scanning direction, and a line-type image forming apparatus equipped with a line-type recording head that ejects liquid droplets and does so without moving to form an image on the sheet as the sheet is moved in the sub-scanning direction.

A maintenance mechanism that maintains performance of the recording head is essential for the image forming apparatus employing the liquid ejection recording method. One of the functions of the maintenance mechanism is to discharge bubbles, foreign substances, coagulated ink, and so forth present in the recording head through nozzles in the recording head in order to prevent irregular ejection of the ink from the nozzles in the recording head.

In addition, a full-color image forming apparatus that forms full-color images using the liquid ejection recording method generally includes two separate recording heads, that is, a recording head that ejects black ink droplets (hereinafter referred to as the first recording head) and a recording head that ejects color ink droplets (hereinafter referred to as the second recording head). In such a full-color image forming apparatus, not only black ink but also color ink is ejected for maintenance of the recording heads even when monochrome printing is performed using only the first recording head, causing a waste of color ink and a concomitant cost increase.

In order to solve those problems, some image forming apparatuses deploy separate carriages for the black and color inks. That is, they include a first carriage mounting a first recording head that ejects black ink droplets and a second carriage mounting a second recording head that ejects color ink droplets. The first and second carriages are separatably dockable with each other.

For example, the first and second carriages may be selectively dockable with each other via a scanner (or a carrier) using a gripper. In order to prevent looseness between the first and second carriages docked with each other via the scanner, shielding plates are respectively provided to the first and second carriages and the scanner. Accordingly, a correction amount for controlling relative positions of the first and second carriages is obtained based on the timing with which each of the shielding plates shields light emitted from a home position sensor provided at a certain position in the image forming apparatus.

In another approach, a lock is provided to the scanner to engage with a gripped portion provided to each of the first and second carriages to lock the scanner and the first and second carriages together.

However, in the above-described configurations, the first and second carriages are docked with and separated from each other through an intermediate member such as the scanner and the gripper. Consequently, the accuracy with which the relative positions of the first and second carriages are secured is decreased due to the use of the intermediate member, thus degrading image quality of full-color images.

Further, repeated docking and separation of the first and second carriages change the relative positions of the first and second carriages. Consequently, target positions to which the ink droplets are ejected from the first and second recording heads onto a recording medium (hereinafter referred to as landing positions) are shifted between the black ink droplets ejected from the first recording head and the color ink droplets ejected from the second recording head, thus degrading image quality of full-color images.

Thus, the relative positions of the first and second carriages are not accurately corrected only by obtaining the correction amount described above.

Meanwhile, there are also image forming apparatuses that correct a timing of ejection of ink droplets from recording heads (hereinafter referred to as an ejection timing) in order to prevent the shift in the landing positions between the black and color ink droplets. Specifically, the image forming apparatus forms an adjustment pattern and reads the adjustment pattern using an optical sensor to correct the ejection timing of the black and color ink droplets, thereby reducing color shift during full-color image formation.

However, although the landing positions can be corrected when the first and second carriages are docked with each other, the above-described image forming apparatus cannot handle variation in the relative positions of the first and second carriages caused by repeated docking and separation of the first and second carriages. As a result, because the relative positions of the first and second carriages may be changed by repeated docking and separation of the first and second carriages, the adjustment pattern must be formed each time the first and second carriages are docked with each other in order to calculate the correction amount.

SUMMARY

In this disclosure, a novel image forming apparatus including first and second carriages separatably dockable with each other is provided to prevent deterioration in image quality of full-color images caused by repeated docking and separation of the first and second carriages.

In one illustrative embodiment, an image forming apparatus includes a first carriage having a first recording head to eject black liquid droplets and movable in a main scanning direction, a second carriage having a second recording head to eject color liquid droplets and separatably dockable with the first carriage, a position detector, and a landing position corrector to correct landing positions of liquid droplets ejected from at least one of the first and second recording heads. The position detector includes a positional reference marker provided to the first carriage and a position reader provided to the second carriage to read the positional reference marker, and detects a position of the second carriage relative to the first carriage in a state in which the first and second carriages are docked with each other. The landing position corrector holds the position of the second carriage obtained by the position detector as a reference position of the second carriage and adjusts a correction amount for correcting the landing positions based on an amount of shift between the reference position and a present position of the second carriage docked with the first carriage for image formation upon correction of the landing positions.

In another illustrative embodiment, a method for correcting landing positions of liquid droplets ejected from at least one of first and second recording heads respectively mounted on first and second carriages and separatably dockable with each other includes the steps of detecting a position of the second carriage relative to the first carriage in a state in which the first and second carriages are docked with each other, holding the position of the second carriage obtained by the detecting as a reference position of the second carriage, adjusting a correction amount for correcting the landing positions based on an amount of shift between the reference position and a present position of the second carriage docked with the first carriage for image formation, and correcting the landing positions based on the correction amount.

Additional aspects, features, and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF THE ILLUSTRATIVE EMBODIMENTS

Figure 1:
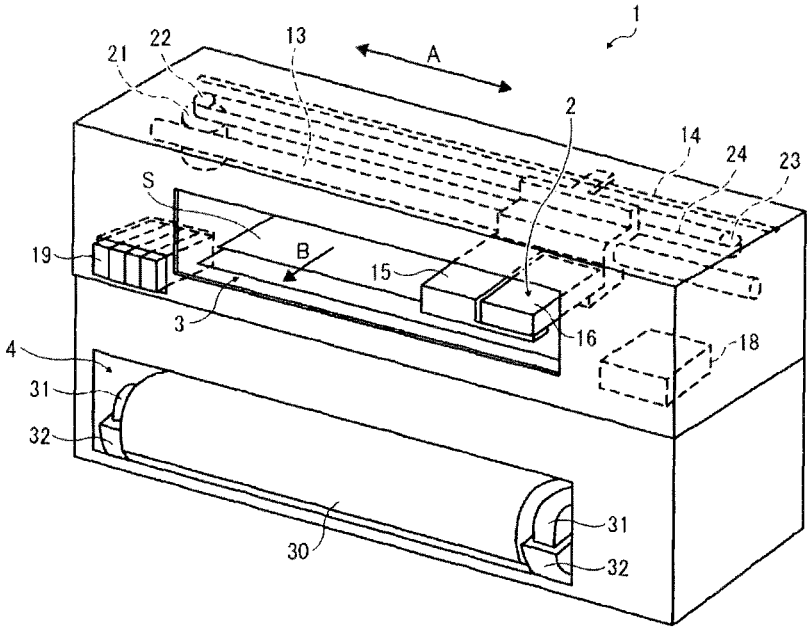
FIG. 1 is a perspective view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Image forming apparatuses hereinafter described form an image on a recording medium, such as paper, string, fiber, cloth, lather, metal, plastics, glass, wood, and ceramics by ejecting liquid droplets onto the recording medium. In this specification, an image refers to both signifying images such as characters and figures, as well as a non-signifying image such as patterns. In addition, ink includes any material which is a liquid when ejected from a recording head, such as a DNA sample, a resist material, and a pattern material. Further, an image formed on the recording medium is not limited to a flat image, but also includes an image formed on a three-dimensional object, a three-dimensional image, and so forth.

Figure 2:
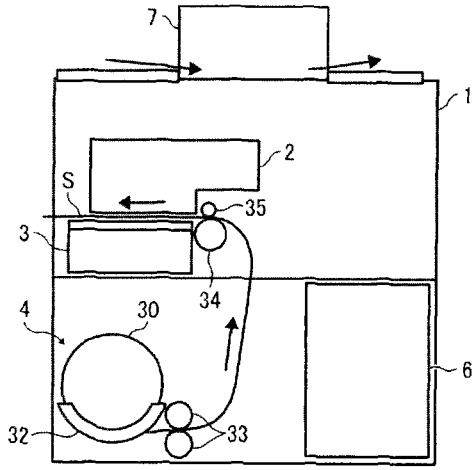
FIG. 2 is a vertical cross-sectional view illustrating the configuration of the image forming apparatus illustrated in FIG. 1.
Figure 3:
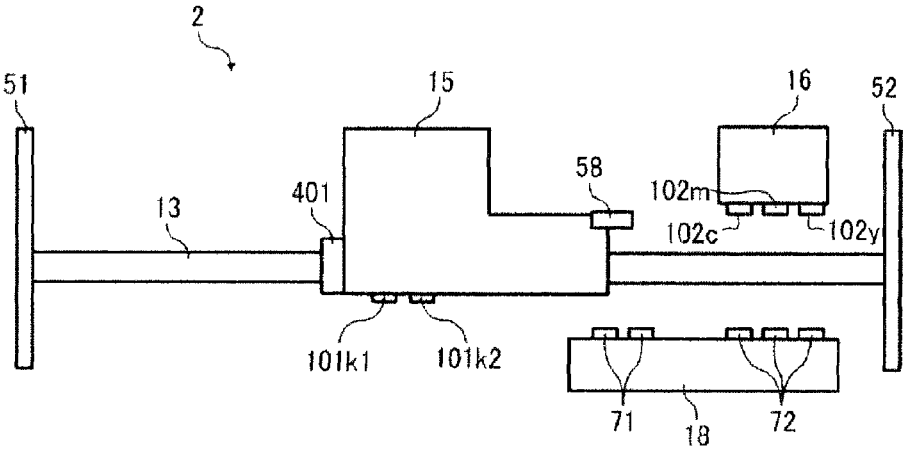
FIG. 3 is a front view illustrating an example of a configuration of an image forming unit of the image forming apparatus illustrated in FIG. 1.

A description is now given of a configuration and operation of an inkjet recording device serving as an image forming apparatus 1 according to illustrative embodiments with reference to FIGS. 1 to 3. FIG. 1 is a perspective view illustrating an example of a configuration of the image forming apparatus 1. FIG. 2 is a vertical cross-sectional view illustrating the configuration of the image forming apparatus 1. FIG. 3 is a front view illustrating a configuration of an image forming unit 2 of the image forming apparatus 1.

The image forming apparatus 1 is a serial-type inkjet recording device, and includes the image forming unit 2, a sheet conveyance unit 3, a sheet roll storage 4, an electrical substrate storage 6, an image reading unit 7 provided at the top thereof, and so forth. It is to be noted that the image reading unit 7 is omitted in FIG. 1 for ease of illustration.

In the image forming unit 2, a guide rod 13 and a guide rail 14 are extended between lateral plates 51 and 52, and a first carriage 15 that ejects black ink droplets is slidably held by the guide rod 13 and the guide rail 14 in a direction indicated by a double-headed arrow A in FIG. 1 (hereinafter referred to as the main scanning direction). A second carriage 16 that ejects color ink droplets can be docked with and separated from the first carriage 15. It is to be noted that FIG. 1 illustrates a state in which the first and second carriages 15 and 16 are docked together, and FIG. 3 illustrates a state in which the first and second carriages 15 and 16 are separated from each other.

A main scanning mechanism that moves the first carriage 15 reciprocally back and forth in the main scanning direction includes a drive motor 21 positioned at one end of the image forming apparatus 1 in the main scanning direction, a drive pulley 22 rotatively driven by the drive motor 21, a driven pulley 23 provided at the other end of the image forming apparatus 1 in the main scanning direction, and a belt member 24 wound around the drive pulley 22 and the driven pulley 23. A tension spring, not shown, applies tension to the driven pulley 23 to separate the driven pulley 23 from the drive pulley 22. A part of the belt member 24 is fixed to a mount provided to a back surface of the first carriage 15 to guide the first carriage 15 in the main scanning direction.

An encoder sheet, not shown, is provided along the main scanning direction in order to detect a main scanning position of the first carriage 15. The encoder sheet is read by an encoder sensor, not shown, provided to the first carriage 15.

The first carriage 15 has a main scanning range through which it scans, and within this range is a recording range. A sheet S fed from a sheet roll 30 is intermittently conveyed to the recording range by the sheet conveyance unit 3 in a direction perpendicular to the main scanning direction indicated by an arrow B in FIG. 1 (hereinafter referred to as the sub-scanning direction).

An ink cartridge 19 that stores ink of a specific color, that is, yellow (Y), cyan (C), magenta (M), or black (K), to be supplied to sub-tanks included in recording heads provided to the first and second carriages 15 and 16, is detachably attached to the image forming apparatus 1 at the one end of the image forming apparatus 1 in the main scanning direction, that is, a portion outside the main scanning range of the first carriage 15. A maintenance mechanism 18 that performs maintenance and recovery of the recording heads is provided at the other end of the image forming apparatus 1 in the main scanning direction within the main scanning range of the first carriage 15.

The sheet roll 30 is set in the sheet roll storage 4 serving as a sheet feed unit. The sheet roll 30 having different widths can be set in the sheet roll storage 4. Flanges 31 are attached to both ends of a paper core of the sheet roll 30 and are placed on flange bearings 32, respectively. Support rollers, not shown, are provided to the flange bearings 32 to contact outer circumferential surfaces of the flanges 31, respectively, thereby rotating the flanges 31 to feed the sheet S from the sheet roll 30.

The sheet S fed from the sheet roll 30 set in the sheet roll storage 4 is conveyed by conveyance members such as a pair of rollers 33, a drive roller 34, and a driven roller 35 from the back to the front of the image forming apparatus 1 to reach the recording range. In monochrome printing, the first carriage 15 is moved reciprocally in the main scanning direction, and the recording heads of the first carriage 15 are driven to eject black ink droplets onto the sheet S based on image data while the sheet S is intermittently conveyed in the sub-scanning direction. By contrast, in full-color printing, the first and second carriages 15 and 16 are docked together, and the recording heads of the first and second carriages 15 and 16 are together driven to eject ink droplets of the specified color onto the sheet S based on image data. Accordingly, a desired image is formed on the sheet S. The sheet S having the image thereon is then cut to a predetermined length and is discharged to a discharge tray, not shown, provided to the front of the image forming apparatus 1.

Figure 4:
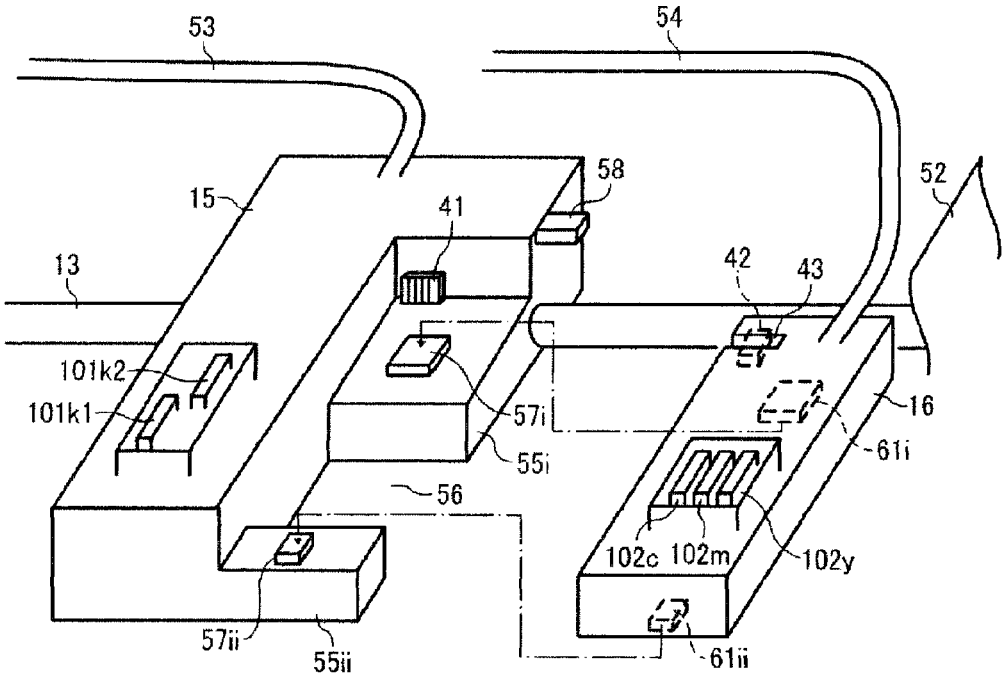
FIG. 4 is a perspective view illustrating an example of a configuration of first and second carriages separated from each other according to illustrative embodiments.
Figure 5:
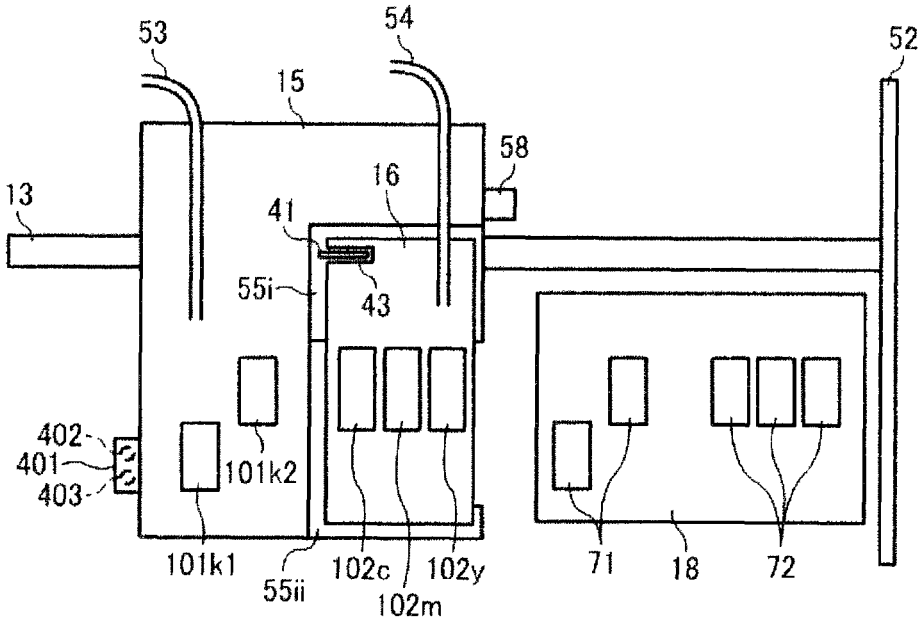
FIG. 5 is a top view illustrating an example of a configuration of the first and second carriages docked with each other according to illustrative embodiments.
Figure 6:
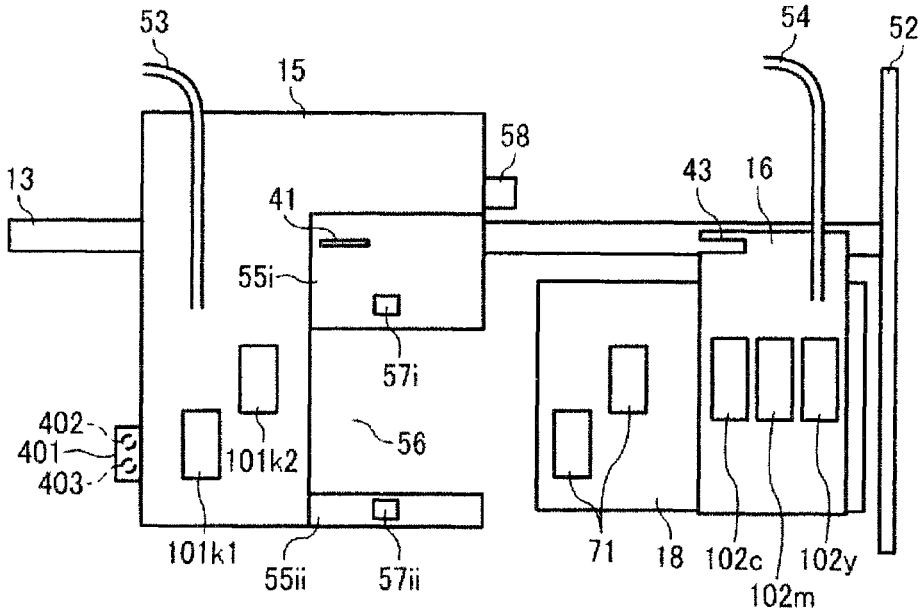
FIG. 6 is a top view illustrating the example of the configuration of the first and second carriages separated from each other.

A description is now given of a configuration of each of the first and second carriages 15 and 16 according to illustrative embodiments with reference to FIGS. 4 to 6. FIG. 4 is a perspective view illustrating an example of a configuration of the first and second carriages 15 and 16 separated from each other according to illustrative embodiments. FIG. 5 is a top view illustrating an example of a configuration of the first and second carriages 15 and 16 docked together. FIG. 6 is a top view illustrating the example of the configuration of the first and second carriages 15 and 16 separated from each other.

The first carriage 15 includes first recording heads 101*k*1 and 101*k*2 (hereinafter collectively referred to as first recording heads 101) each including a liquid ejection head that ejects black ink droplets. The first recording heads 101 are offset from each other in the main scanning direction on the first carriage 15, and the first carriage 15 is moved reciprocally in the main scanning direction along the guide rod 13 by the main scanning mechanism. Black ink is supplied from the ink cartridge 19 provided to the image forming apparatus 1 to the sub-tanks integrally formed with the first recording heads 101 through a tube 53. Alternatively, replaceable ink cartridges may be attached to the first recording heads 101.

The second carriage 16 includes second recording heads 102*c*, 102*m*, and 102*y* (hereinafter collectively referred to as second recording heads 102), each including a liquid ejection head that ejects ink droplets of a specific color, that is, cyan (C), magenta (M), or yellow (Y). The second recording heads 102 are positioned at the same position as the first recording head 101*k*2 in the main scanning direction. The second carriage 16 is docked with the first carriage 15 to be moved reciprocally in the main scanning direction together with the first carriage 15 by reciprocating movement of the first carriage 15. Ink of the specified color is supplied from the ink cartridge 19 provided to the image forming apparatus 1 to the sub-tanks integrally formed with the second recording heads 102 through a tube 54. Alternatively, replaceable ink cartridges may be attached to the second recording heads 102.

The first carriage 15 has mounts 55*i* and 55*ii* (hereinafter collectively referred to as mounts 55) to place the second carriage 16 thereon, and a cutout 56 is formed between the mounts 55. When the second carriage 16 is placed on the mounts 55 to be docked with the first carriage 15, the color ink droplets are ejected from the second recording heads 102 of the second carriage 16 onto the sheet S through the cutout 56, and caps 72 of the maintenance mechanism 18 described in detail later are moved up and down within the cutout 56. The mounts 55 respectively have engaging members 57*i* and 57*ii* (hereinafter collectively referred to as engaging members 57) each separatably engageable with engaging members 61*i* and 61*ii* (hereinafter collectively referred to as engaging members 61) provided to the second carriage 16.

The first carriage 15 further includes a protrusion 58 that protrudes toward the lateral plate 52 beyond the second carriage 16 when the first carriage 15 is docked with the second carriage 16. The protrusion 58 is used for detecting a reference position of the first carriage 15. Specifically, a position where the protrusion 58 contacts the lateral plate 52 is detected by, for example, detecting a change in a drive current of the drive motor 21, and the first carriage 15 is moved from that position to a direction opposite the lateral plate 52 by a predetermined amount and the resultant position of the first carriage 15 is set as the reference position. A home position of the first carriage 15 can be detected in a manner similar to detection of the reference position of the first carriage 15 as described above, and may be the same as or different from the reference position.

Alternatively, a detection member may be provided to the first carriage 15 in place of the protrusion 58 so that relative positions of the detection member and a reference position provided to the main body of the image forming apparatus 1 are detected to determine the reference position of the first carriage 15. In such a case, the reference position of the first carriage 15 may be determined by, for example, a reference position detector such as a sensor provided to the main body of the image forming apparatus 1, or by matching of a result detected by the encoder sensor that detects the position of the first carriage 15 and a preset reference position.

The first carriage 15 further includes a positional reference marker 41 having a configuration similar to an encoder scale. The second carriage 16 further includes a position reader 42 having a configuration similar to the encoder sensor. The position reader 42 reads the positional reference marker 41 of the first carriage 15 to detect a position of the second carriage 16 relative to the first carriage 15. In other words, a linear encoder including the positional reference marker 41 and the position reader 42 is provided as a position detector that detects the position of the second carriage 16 relative to the first carriage 15. The second carriage 16 further has a slot 43, which the positional reference marker 41 can enter and be accommodated within.

Figure 7:
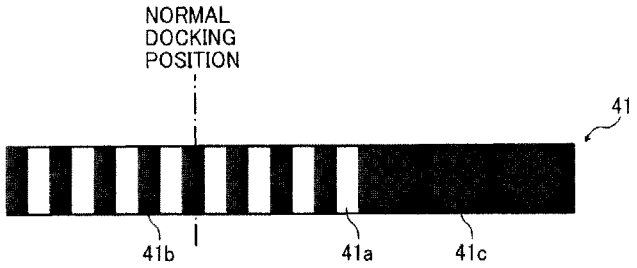
FIG. 7 is a schematic view illustrating an example of a configuration of a positional reference marker provided to the first carriage.

FIG. 7 is a schematic view illustrating an example of a configuration of the positional reference marker 41 of the first carriage 15. In a manner similar to the encoder scale, transparent portions 41*a* and opaque portions 41*b* are alternately formed in the positional reference marker 41, and pulses corresponding to the transparent portions 41*a* and the opaque portions 41*b* are output from the position reader 42. A wide opaque portion 41*c* is provided at one end of the positional reference marker 41 to detect a position from where reading of the positional reference marker 41 is started by the position reader 42.

For example, the position of the second carriage 16 relative to the first carriage 15 when the first and second carriages 15 and 16 are properly docked with each other is set as a normal docking position shown in FIG. 7, that is, a position at which four pulses are obtained after detection of the opaque portion 41*c*. The number of pulses obtained after the detection of the opaque portion 41*c* when the first and second carriages 15 and 16 are actually docked with each other, that is, an actual position of the second carriage 16, is compared with the normal docking position to obtain an amount of shift from the normal docking position.

Figure 8:
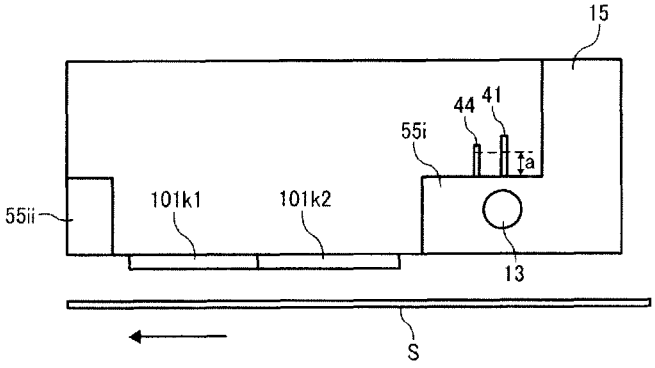
FIG. 8 is a vertical cross-sectional view illustrating relative positions of the positional reference marker and first recording heads or a recording range in a sheet.

A description is now given of another example of a configuration of the positional reference marker 41 with reference to FIG. 8. FIG. 8 is a vertical cross-sectional view illustrating relative positions of the positional reference marker 41 and the first recording heads 101 or a recording range in the sheet S.

As illustrated in FIG. 8, the positional reference marker 41 is positioned above nozzle surfaces of the first recording heads 101. Accordingly, the positional reference marker 41 is prevented from being contaminated by ink scattering or ink mist from the nozzle.

Further, a wall 44 having a height equal to or higher than a height a at which the positional reference marker 41 is read by the position reader 42 is provided between the nozzle surfaces of the first recording heads 101 or the recording range in the sheet S and the positional reference marker 41 in the sub-scanning direction. Accordingly, the positional reference marker 41 is more reliably prevented from being contaminated by ink scattering and ink mist. Although not limited thereto, for example, the wall 44 may have a shape of a rib and be formed of a shielding material such as a metal sheet or Mylar®.

As a result, the position reader 42 can reliably read the positional reference marker 41, and at the same time durability of the positional reference marker 41 is enhanced.

Returning to FIGS. 5 and 6, a pattern detector 401 serving a pattern reader that reads an adjustment pattern 400 formed on the sheet S is provided on a lateral surface of the first carriage 15. The pattern detector 401 is an optical sensor including a reflective-type photosensor. Specifically, the pattern detector 401 includes a light emitter 402 that emits light onto the adjustment pattern 400 and a light receiver 403 that receives the light reflected from the adjustment pattern 400. The adjustment pattern 400 described in detail later is formed on the sheet S for automatically correcting a shift in positions to where ink droplets are ejected from the first and second recording heads 101 and 102 on the sheet S (hereinafter referred to as landing positions).

Figure 9:
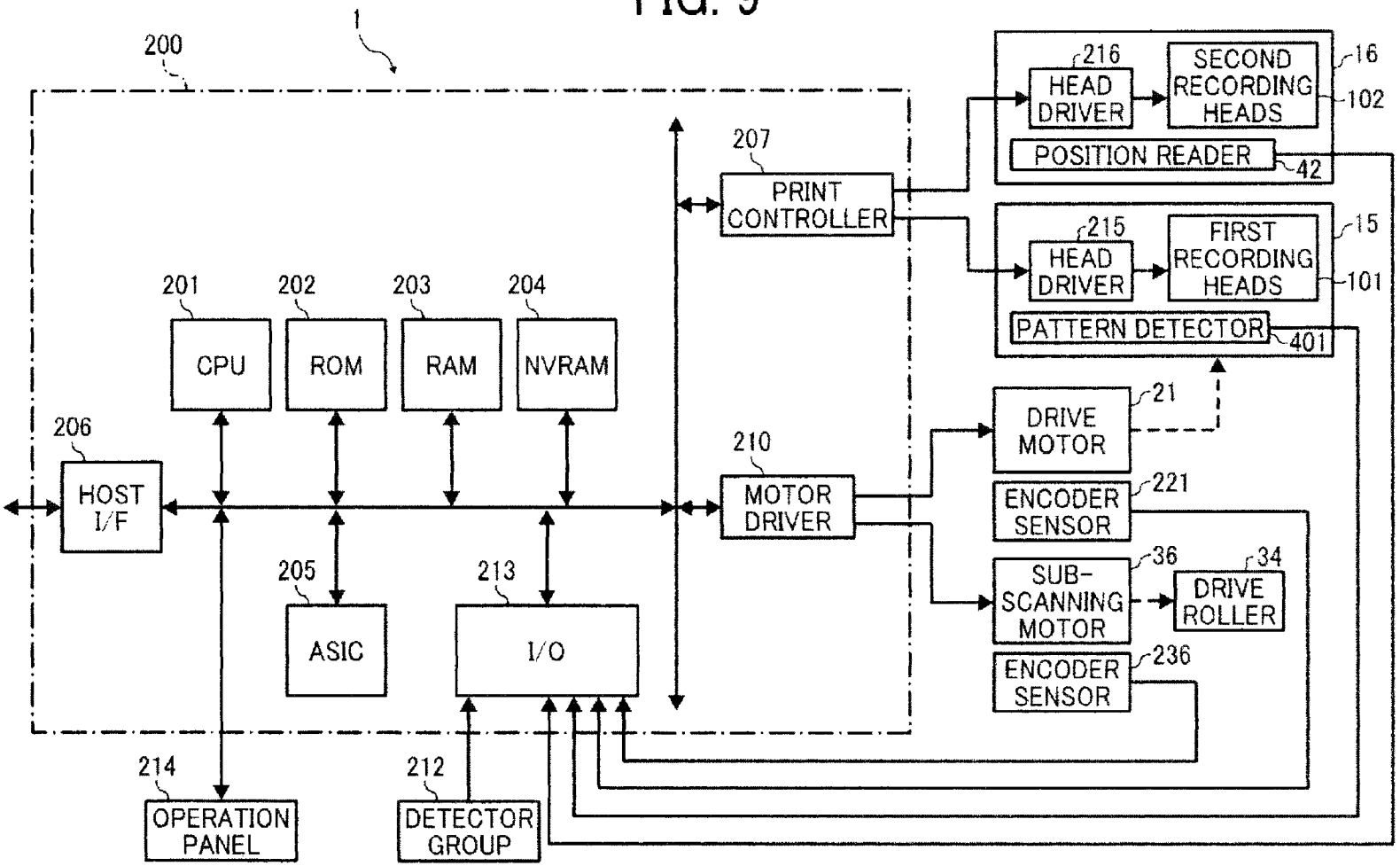
FIG. 9 is a block diagram illustrating an example of a configuration and operation of a control unit of the image forming apparatus according to illustrative embodiments.

A description is now given of an example of a configuration and operation of a control unit 200 of the image forming apparatus 1 according to illustrative embodiments with reference to FIG. 9. FIG. 9 is a block diagram illustrating an example of a configuration and operation of the control unit 200.

The control unit 200 controls the image forming apparatus 1 and includes a CPU 201 serving also as a landing position corrector, a ROM 202 that stores fixed data and various programs including a program for performing processing relating to correction of the landing positions performed by the CPU 201, a RAM 203 that temporarily stores image data and so forth, a nonvolatile rewritable memory (NVRAM) 204 that holds data while power supply to the image forming apparatus 1 is blocked, and an ASIC 205 that performs signal processing for image data and image processing such as sorting of the image data and handles input/output signals for controlling the image forming apparatus 1.

The control unit 200 further includes a host I/F 206 that sends and receives data and signals to and from a host; a print controller 207 including a data transfer unit for controlling driving of the liquid ejection heads, that is, the first and second recording heads 101 and 102, and a drive waveform generator that generates a drive waveform; a motor driver 210 for driving the drive motor 21 and a sub-scanning motor 36 that rotates the drive roller 34; and an I/O 213 that inputs various detection signals output from encoder sensors 221 and 236, the position reader 42, and the pattern detector 401 as well as various detection signals output from a detector group 212 including a temperature detector that detects a surrounding temperature causing a shift in the landing positions. An operation panel 214 through which data necessary for the image forming apparatus 1 is input and on which such data is displayed is connected to the control unit 200.

The control unit 200 receives image data and so forth sent from the host including an information processing device such as a personal computer and an image reading device such as an image scanner using the host I/F 206 through a cable or a network, which may be either wired or wireless.

The CPU 201 of the control unit 200 reads image data from a reception buffer included in the host I/F 206 and analyzes the image data so that image processing and sorting of the image data are performed by the ASIC 205 as needed. The resultant image data is transferred from the print controller 207 to a head driver 215 for the first recording heads 101 of the first carriage 15 and a head driver 216 for the second recording heads 102 of the second carriage 16. It is to be noted that dot pattern data for outputting an image on the sheet S is generated by a printer driver provided to the host.

The print controller 207 transfers the above-described image data as serial data to the head drivers 215 and 216 and outputs a transfer clock, a clutch signal, a mask signal, and so forth each necessary for transferring the image data and confirming transfer of the image data to the head drivers 215 and 216. As described above, the print controller 207 includes the drive waveform generator having a voltage amplifier, a current amplifier, a D/A converter that performs digital/analog conversion of pattern data of a drive signal stored in the ROM 202, and so forth. The print controller 207 further includes a drive waveform selector that outputs a drive waveform having a single drive pulse or multiple drive pulses generated by the drive waveform generator to the head drivers 215 and 216.

The head drivers 215 and 216 selectively apply the drive signal forming the drive waveform output from the print controller 207 to a drive element such as a piezoelectric element that generates energy to drive the first and second recording heads 101 and 102 to eject the ink droplets based on a single line of the image data serially input to the first and second recording heads 101 and 102. At this time, a size of a dot of the ink droplet ejected from the first and second recording heads 101 and 102 can be changed to small, medium, or large by selecting the drive pulse that forms the drive waveform as appropriate.

The CPU 201 calculates a drive output value (or a control value) for the drive motor 21 based on a speed detection value and a position detection value each obtained by sampling a detection pulse output from the encoder sensor 221 and a target speed value and a target position value obtained from prestored speed and position profiles so that the drive motor 21 is driven by the CPU 201 through the motor driver 210. Similarly, the CPU 201 calculates a drive output value (or a control value) for the sub-scanning motor 36 based on a speed detection value and a position detection value each obtained by sampling a detection pulse output from the encoder sensor 236 and a target speed value and a target position value obtained from prestored speed and position profiles so that the sub-scanning motor 36 is driven by the CPU 201 through the motor driver 210.

As described previously, the CPU 201 also serves as a landing position corrector. Specifically, the CPU 201 causes the first and second recording heads 101 and 102 to form the adjustment pattern 400 for correcting a shift in the landing positions on the sheet S. The adjustment pattern 400 thus formed is read by the pattern detector 401. The CPU 201 calculates a correction amount to correct a timing at which the first and second recording heads 101 and 102 eject the ink droplets (hereinafter referred to as an ejection timing) for image formation based on the result obtained by the pattern detector 401. Thereafter, the CPU 201 sends the correction amount thus calculated to the print controller 207 to correct a shift in the landing positions.

Upon docking of the first and second carriages 15 and 16, a position of the second carriage 16 relative to the first carriage 15, that is, an amount of shift from the reference position of the second carriage 16, is detected based on a detection signal output from the position reader 42 when acceleration of scanning speed of the first and second carriages 15 and 16 is completed in front of the recording range in the main scanning direction. The correction amount for correcting a shift in the landing positions is changed based on the amount of shift thus detected.

Figure 10:
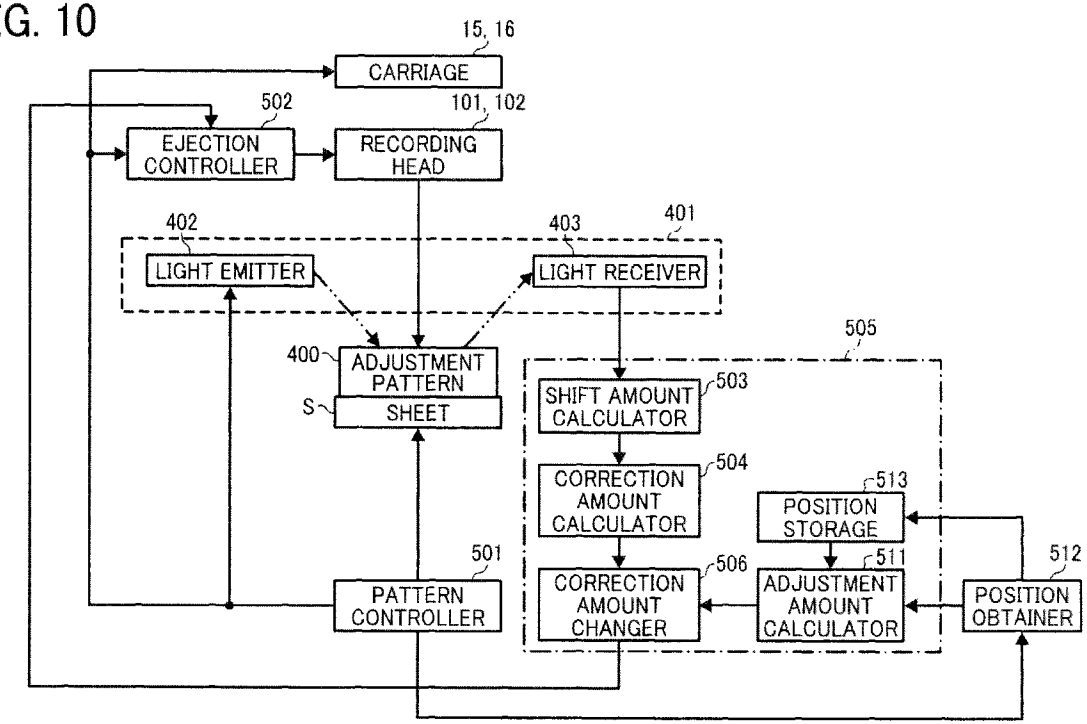
FIG. 10 is a block diagram illustrating an example of a configuration and operation of a shift corrector.
Figure 11:
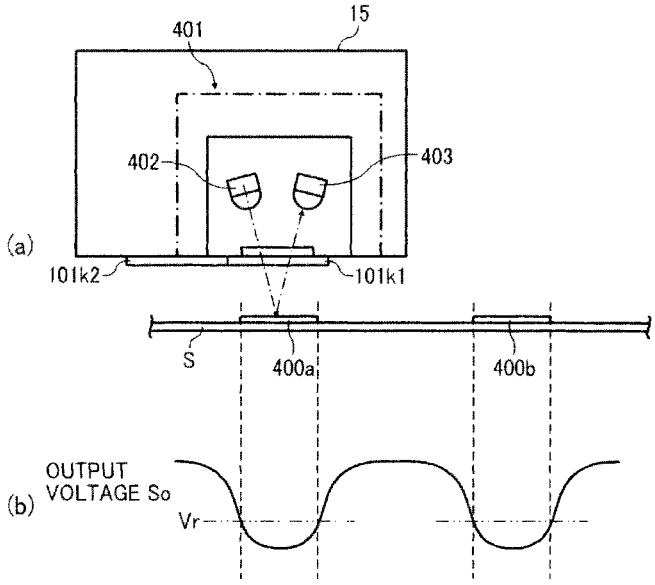
FIGS. 11(*a*) and 11(*b*) are schematic views respectively illustrating operation of correcting a shift in landing positions.
Figure 12:
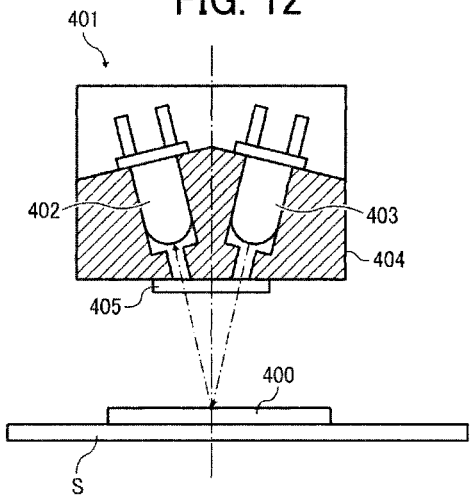
FIG. 12 is a schematic view illustrating an example of a configuration of a pattern detector.

A description is now given of correction of a shift in the landing positions with reference to FIGS. 10 to 12. FIG. 10 is a block diagram illustrating an example of a configuration and operation of a shift corrector 505. FIGS. 11(*a*) and 11(*b*) are schematic views illustrating operation of correcting a shift in the landing positions. FIG. 12 is a schematic view illustrating an example of a configuration of the pattern detector 401.

As described above, the first carriage 15 includes the pattern detector 401 that reads the adjustment pattern 400 formed on the sheet S for correcting a shift in the landing positions. It is to be noted that the adjustment pattern 400 is formed of at least a reference pattern 400*a* and a measured pattern 400*b*.

The pattern detector 401 includes the light emitter 402 that emits light to the adjustment pattern 400 formed on the sheet S and the light receiver 403 that receives the light regularly or diffusively reflected from the adjustment pattern 400. The light emitter 402 and the light receiver 403 are disposed side by side in a direction perpendicular to the main scanning direction, that is, the sub-scanning direction, and are held in a holder 404. The holder 404 has a lens 405 at a portion through which the light is emitted or entered.

As described above, the light emitter 402 and the light receiver 403 are disposed side by side in the sub-scanning direction within the pattern detector 401. Accordingly, a change in the scanning speed of the first carriage 15 hardly affects the result detected by the pattern detector 401. A relatively simple and inexpensive light source such as an optical LED may be used as the light emitter 402. Further, an inexpensive lens is used for a spot size of the light source, thereby achieving mm-order detection accuracy.

The image forming apparatus 1 further includes a pattern controller 501 that causes the first carriage 15 to move in the main scanning direction and the first and second recording heads 101 and 102 to eject the ink droplets through an ejection controller 502. Accordingly, the adjustment pattern 400 including the reference pattern 400*a* and the measured pattern 400*b* each having a linear shape is formed on the sheet S.

The pattern controller 501 controls the pattern detector 401 to read the adjustment pattern 400 formed on the sheet S. Specifically, the pattern controller 501 drives the light emitter 402 of the pattern detector 401 to emit light while causing the first carriage 15 to move in the main scanning direction so that the light is emitted from the light emitter 402 to the adjustment pattern 400 formed on the sheet S.

The light emitted from the light emitter 402 to the adjustment pattern 400 is reflected from the adjustment pattern 400 and strikes the light receiver 403. Accordingly, a detection signal is output from the light receiver 403 corresponding to an amount of light reflected from the adjustment pattern 400. The detection signal thus output is then input into a shift amount calculator 503 included in the shift corrector 505.

The shift amount calculator 503 obtains a time interval between each of the reference patterns 400*a* and a time interval between the reference patterns 400*a* and the measured patterns 400*b* based on the result output from the light receiver 403, and a distance between each of the reference patterns 400*a* based on the scanning speed of the first carriage 15. Then, the shift amount calculator 503 calculates a distance between the reference patterns 400*a* and the measured patterns 400*b* and corrects the distance thus calculated based on the distance between each of the reference patterns 400*a* and a theoretical distance between each of the reference patterns 400*a*. As a result, an amount of shift of the measured pattern 400*b* from the reference position, that is, an amount of shift in the landing positions, is calculated.

The amount of shift in the landing positions calculated by the shift amount calculator 503 is then sent to a correction amount calculator 504. The correction amount calculator 504 calculates a correction amount that corrects a timing at which the ejection controller 502 drives at least one of the first and second recording heads 101 and 102 to eject the ink droplets onto the sheet S such that the amount of shift in the landing positions is eliminated. The correction amount thus calculated is changed by a correction amount changer 506 described in detail later and is then set to the ejection controller 502. Accordingly, the ejection controller 502 corrects the ejection timing based on the correction amount and appropriately drives at least one of the first and second recording heads 101 and 102, thereby preventing a shift in the landing positions.

A position obtainer 512 obtains the position of the second carriage 16 relative to the first carriage 15 from the position reader 42 when the landing positions are corrected using the adjustment pattern 400 and stores the position of the second carriage 16 thus obtained in a position storage 513 as the reference position of the second carriage 16. Further, the position obtainer 512 obtains the position of the second carriage 16 when the first and second carriages 15 and 16 are docked with each other for full-color image formation, that is, the present position of the second carriage 16, and sends it to an adjustment amount calculator 511.

The adjustment amount calculator 511 calculates an adjustment amount for the correction amount of the landing positions based on a deviation between the present position of the second carriage 16 and the reference position of the second carriage 16 and sends the adjustment amount thus calculated to the correction amount changer 506. The correction amount changer 506 changes the correction amount output from the correction amount calculator 504 based on the adjustment amount calculated by the adjustment amount calculator 511.

Figure 13A:
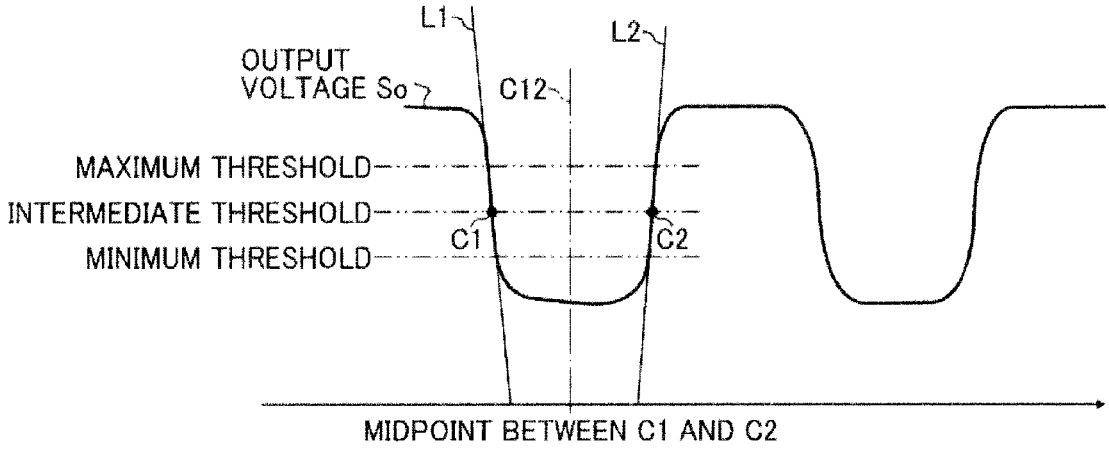
FIG. 13A is a graph illustrating an output voltage So obtained by scanning the pattern detector on a reference pattern and a measured pattern.
Figure 13B:
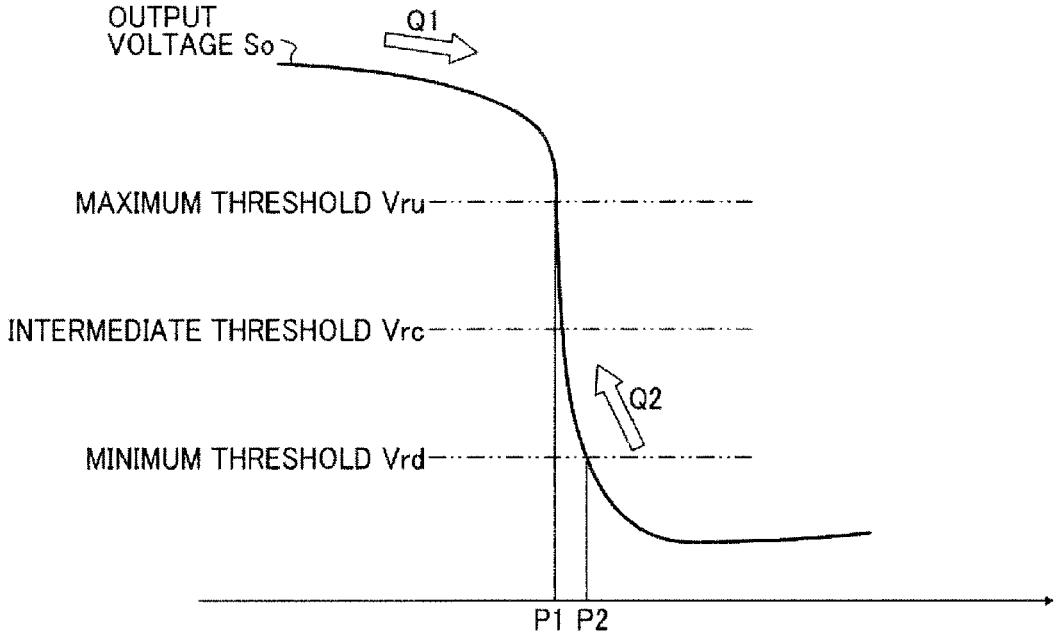
FIG. 13B is an enlarged graph illustrating a portion at a falling edge of the output voltage So illustrated in FIG. 13A.

A description is now given of detection of a position of the adjustment pattern 400 formed on the sheet S and calculation of a distance between the reference pattern 400*a* and the measured pattern 400*b* with reference to FIGS. 13A and 13B. FIG. 13A is a graph illustrating an output voltage So obtained by scanning the pattern detector 401 on the reference pattern 400*a* and the measured pattern 400*b*. FIG. 13B is an enlarged graph illustrating a portion at a falling edge of the output voltage So illustrated in FIG. 13A.

The portion at the falling edge of the output voltage So is searched in a direction indicated by an arrow Q1 in FIG. 13B, and a point where the output voltage So falls below a minimum threshold Vrd is stored as a point P2. Next, the output voltage So is searched from the point P2 in a direction indicated by an arrow Q2 in FIG. 13B, and a point where the output voltage So exceeds a maximum threshold Vru is stored as a point P1. Then, a regression line L1 is calculated from the output voltage So between the points P1 and P2, and an intersection point C1 of the regression line L1 and an intermediate threshold Vrc between the maximum and minimum thresholds Vru and Vrd is calculated using the regression line L1 thus obtained. Similarly, a regression line L2 at a portion at a rising edge of the output voltage So is calculated to calculate an intersection point C2 of the regression line L2 and the intermediate threshold Vrc. Thereafter, a midpoint between the intersection points C1 and C2 (C1+C2/2) is calculated to obtain a line center C12.

Accordingly, the distance between the reference pattern 400*a* and the measured pattern 400*b* is obtained. Alternatively, the distance between the reference pattern 400*a* and the measured pattern 400*b* may be calculated from scanning speed and a scanning time of the first carriage 15, thereby simplifying processing.

Figure 14:
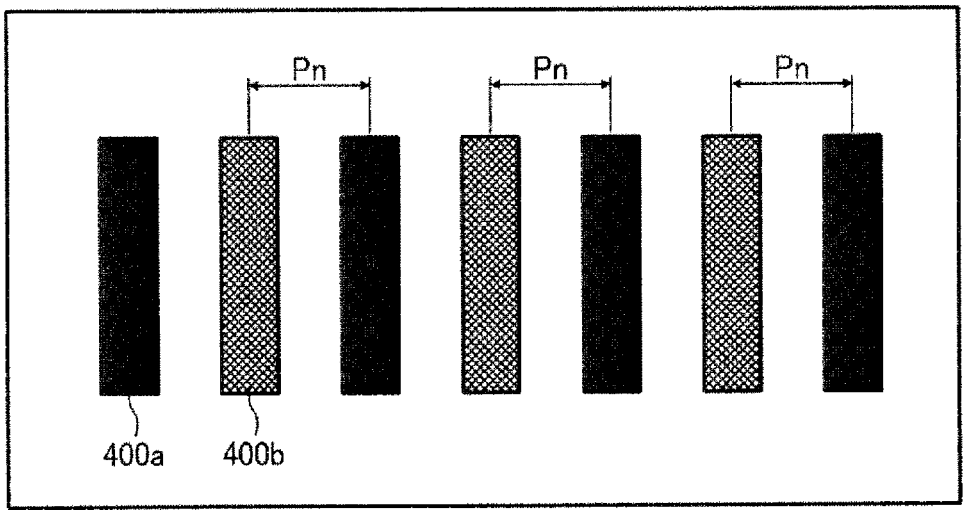
FIG. 14 is a schematic view illustrating an example of an adjustment pattern used for automatic adjustment of the landing positions.

A description is now given of the adjustment pattern 400 for automatically adjusting the landing positions with reference to FIG. 14. FIG. 14 is a schematic view illustrating an example of the adjustment pattern 400 used for automatic adjustment of the landing positions.

As illustrated in FIG. 14, each of the reference patterns 400*a* and the measured patterns 400*b* in the adjustment pattern 400 has a linear shape. The reference patterns 400*a* are formed by a recording head determined in advance, that is, for example, the first recording head 101*k*1, and the ejection timing of the other recording heads, that is, for example, the first recording heads 101*k*2 and the second recording heads 102, are adjusted based on the reference patterns 400*a*.

In such a case, the reference patterns 400*a* and the measured patterns 400*b* are alternately formed as illustrated in FIG. 14. Then, a distance Pn between a central line of each of the reference patterns 400*a* and a central line of each of the measured patterns 400*b* is calculated based on the result obtained by the pattern detector 401 described above. It is to be noted that multiple types of the measured patterns 400*b* are formed by outward and homeward movement of the recording heads to be adjusted, that is, the first recording head 101*k*2 and the second recording heads 102, only one of which is shown in FIG. 14.

Figure 15:
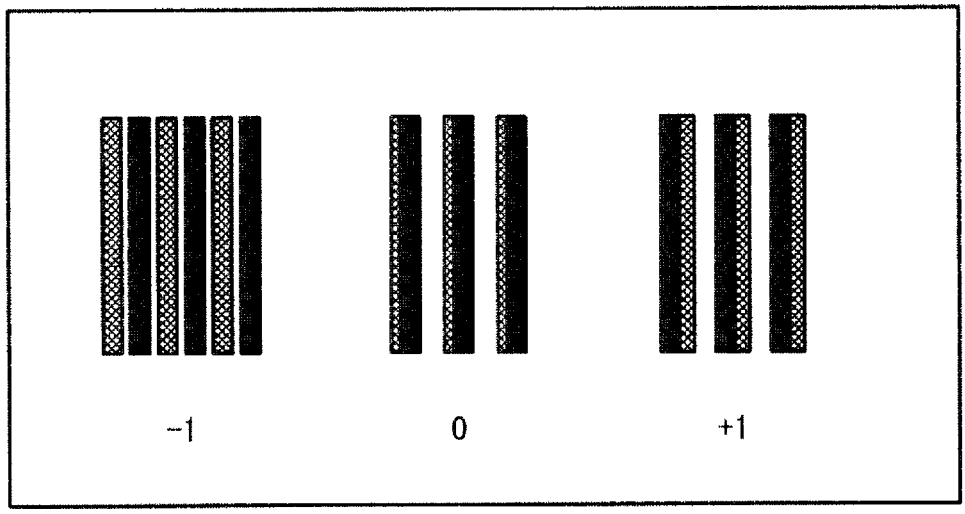
FIG. 15 is a schematic view illustrating examples of adjustment patterns used for manual adjustment of the landing positions.

A description is now given of manual adjustment of the positions without using the pattern detector 401 with reference to FIG. 15. FIG. 15 is a schematic view illustrating an example of the adjustment pattern 400 used for manual adjustment of the landing positions.

Also in manual adjustment of the landing positions, each of the reference patterns 400*a* and the measured patterns 400*b* in the adjustment pattern 400 has a linear shape. The reference patterns 400*a* are formed by a recording head determined in advance, that is, for example, the first recording head 101*k*1, and the ejection timing of the other recording heads, that is, for example, the first recording head 101*k*2 and the second recording heads 102, are adjusted based on the reference patterns 400*a* to correct the landing positions.

In such a case, the reference patterns 400*a* and the measured patterns 400*b* are alternately formed such that they gradually overlap with each other as illustrated in FIG. 15. Each of the adjustment patterns 400 is numbered with, for example, −1, 0, +1, and so on, depending on the distance Pn.

A user inputs the number or the distance Pn of the adjustment pattern 400 which has the largest white background through the operation panel 214 or the host so that the image forming apparatus 1 uses the correction amount corresponding to the distance Pn thus input to adjust the landing positions. It is to be noted that multiple types of the measured patterns 400*b* are formed by outward and homeward scanning movement of the recording heads to be adjusted, that is, the first recording head 101*k*2 and the second recording heads 102.

Figure 16:
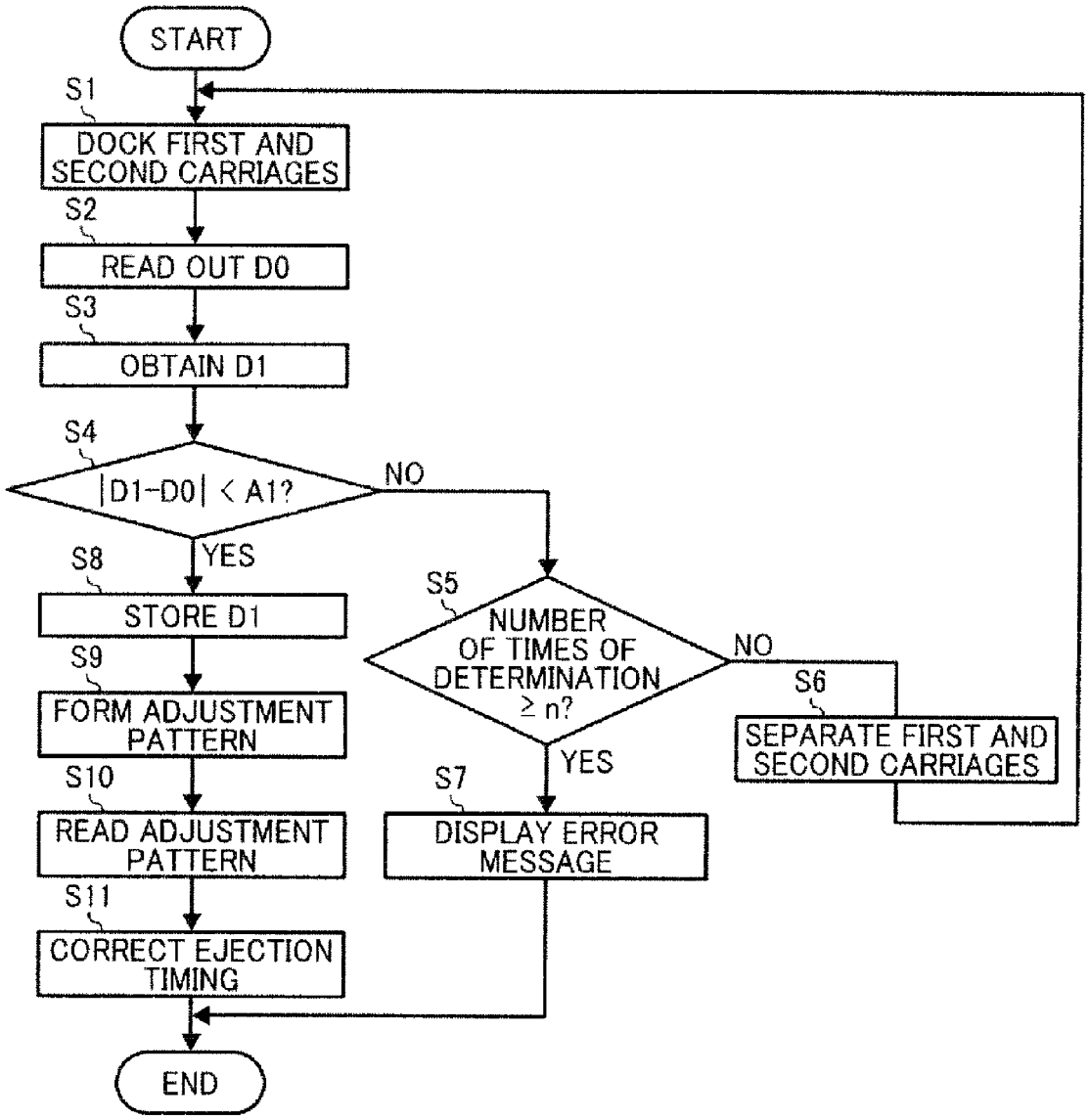
FIG. 16 is a flowchart illustrating steps in a process of automatic adjustment of the landing positions according to a first illustrative embodiment.

A description is now given of automatic adjustment of the landing positions according to a first illustrative embodiment with reference to FIG. 16. FIG. 16 is a flowchart illustrating steps in a process of automatic adjustment of the landing positions according to the first illustrative embodiment.

At the start of automatic adjustment of the landing positions, the first and second carriages 15 and 16 are separated from each other. Therefore, at step S1, the first and second carriages 15 and 16 are docked with each other. At S2, a default pulse count D0 between the first and second carriages 15 and 16 prestored in the ROM 202 or the like is read out. In other words, the pulse count D0 is the number of pulses obtained at the normal docking position illustrated in FIG. 7.

It is to be noted that the number of pulses obtained by reading the transparent portions 41*a* and the opaque portions 41*b* of the positional reference marker 41 using the position reader 42 after detection of the opaque portion 41*c* upon docking of the first and second carriages 15 and 16 is the pulse count between the first and second carriages 15 and 16.

At S3, a pulse count D1 is obtained from the detection signal output from the position reader 42 when the first and second carriages 15 and 16 are docked with each other. The pulse count D1 is used as a reference position of the second carriage 16. At S4, it is determined whether or not a difference between the pulse counts D1 and D0 (D1−D0) is smaller than a preset threshold value A1.

When the difference between the pulse counts D1 and D0 is not smaller than the threshold value A1 (NO at S4), there is a possibility that the first and second carriages 15 and 16 are not properly docked with each other. Therefore, the first and second carriage 15 and 16 are separated from each other at S6, and the process returns to S1 to dock the first and second carriages 15 and 16 with each other again. Before separation of the first and second carriages 15 and 16, at S5 it is determined whether or not the number of times a determination is performed at S4 is equal to or greater than a predetermined number n. Because the image forming apparatus 1 may have a problem when the number of times the determination is performed is equal to or greater than the predetermined number n (YES at S5), the process proceeds to S7 to display an error message reporting a possible malfunction on the operation panel 413 or the like to complete the process.

Compared to the preset threshold value A1 set as several hundred μm, variation in the position of the second carriage 16 relative to the first carriage 15 upon docking obtained by subtracting the default pulse count D0 from the pulse count D1 is extremely small, for example, in a range between several μm and several dozen μm. Further, because the variation in the position of the second carriage 16 relative to the first carriage 15 upon docking is generally caused by mechanical tolerance of a docking mechanism or looseness due to abrasion, the position of the second carriage 16 is changed only within a certain range and an amount of movement of the second carriage 16 in one direction is hardly accumulated. Therefore, the variation in the position of the second carriage 16 relative to the first carriage 15 upon docking does not get mixed up with failure of docking of the first and second carriages 15 and 16.

By contrast, when the difference between the pulse counts D1 and D0 is smaller than the threshold value A1 (YES at S4), the process proceeds to S8 to store the pulse count D1 in a storage such as the RAM 203.

At S9, the adjustment pattern 400 for correcting a shift in the landing positions is formed on the sheet S. At S10, the pattern detector 401 reads the adjustment pattern 400 to obtain the correction amount. At S11, the ejection timing is corrected based on the correction amount.

Figure 17:
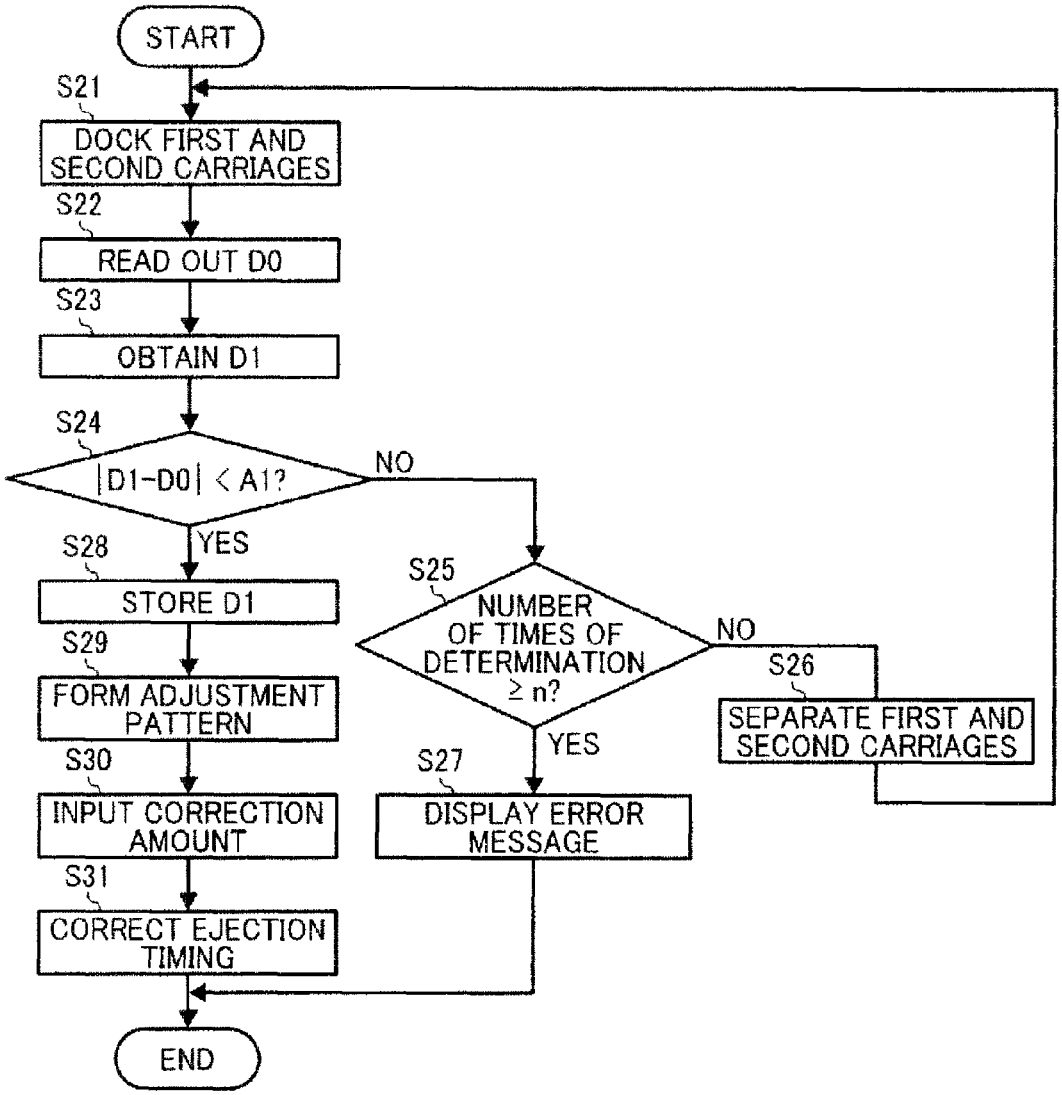
FIG. 17 is a flowchart illustrating steps in a process of manual adjustment of the landing positions according to the first illustrative embodiment.

A description is now given of manual adjustment of the landing positions according to the first illustrative embodiment with reference to FIG. 17. FIG. 17 is a flowchart illustrating steps in a process of manual adjustment of the landing positions according to the first illustrative embodiment.

Similar to automatic adjustment described above, at the start of manual adjustment of the landing positions, the first and second carriages 15 and 16 are separated from each other. Therefore, at step S21, the first and second carriages 15 and 16 are docked with each other. At S22, the default pulse count D0 prestored in the ROM 202 or the like is read out. At S23, the pulse count D1 is obtained from the detection signal output from the position reader 42 when the first and second carriages 15 and 16 are docked with each other. The pulse count D1 is used as a reference position of the second carriage 16. At S24, it is determined whether or not a difference between the pulse counts D1 and D0 (D1−D0) is smaller than a preset threshold value A1.

When the difference between the pulse counts D1 and D0 is not smaller than the threshold value A1 (NO at S24), there is a possibility that the first and second carriages 15 and 16 are not properly docked with each other. Therefore, the first and second carriage 15 and 16 are separated from each other at S26, and the process returns to S11 to dock the first and second carriages 15 and 16 with each other again. Before separation of the first and second carriages 15 and 16, at S25 it is determined whether or not the number of times a determination is performed at S24 is equal to or greater than a predetermined number n. Because the image forming apparatus 1 may have a problem when the number of times the determination is performed is equal to or greater than the predetermined number n (YES at S25), the process proceeds to S27 to display an error message reporting a possible malfunction on the operation panel 413 or the like to complete the process.

By contrast, when the difference between the pulse counts D1 and D0 is smaller than the threshold value A1 (YES at S24), the process proceeds to S28 to store the pulse count D1 in a storage such as the RAM 203.

At S29, the adjustment pattern 400 for correcting a shift in the landing positions is formed on the sheet S. At S30, the correction amount is input by the user. At S31, the ejection timing is corrected based on the correction amount thus input.

Above-descried automatic and manual adjustment can correct the landing positions using the same correction amount as long as the relative positions of the first and second carriages 15 and 16 are the same even when docking of the first and second carriages 15 and 16 is repeatedly performed. However, as described above, the relative positions of the first and second carriages 15 and 16 may be changed due to repeated docking of the first and second carriages 15 and 16.

Therefore, in the first illustrative embodiment, the position of the second carriage 16 relative to the first carriage 15 upon correction of the landing positions using the adjustment pattern 400 is held as the reference position of the second carriage 16, that is, the pulse count D1. When the first and second carriages 15 and 16 are docked with each other to form full-color images, the correction amount of the landing positions is changed based on a difference between the reference position and the actual position of the second carriage 16 upon docking.

Figure 18:
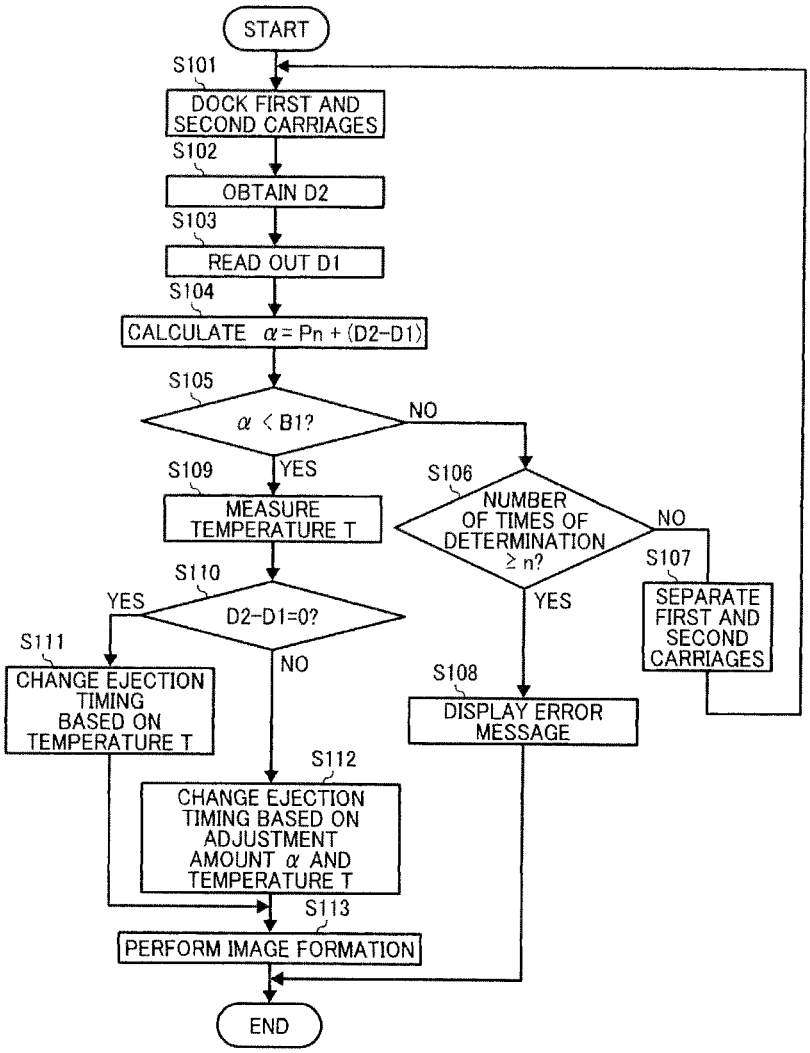
FIG. 18 is a flowchart illustrating steps in a process of changing a correction amount of the landing positions during full-color image formation according to the first illustrative embodiment.

A description is now given of changing of the correction amount of the landing positions during full-color image formation according to the first illustrative embodiment with reference to FIG. 18. FIG. 18 is a flowchart illustrating steps in a process of changing the correction amount of the landing positions during full-color image formation according to the first illustrative embodiment.

At the start of the operation, the first and second carriages 15 and 16 are separated from each other. Therefore, at step S101, the first and second carriages 15 and 16 are docked with each other. At S102, a pulse count D2 is obtained from the detection signal output from the position reader 42 upon docking of the first and second carriages 15 and 16. At 103, the pulse count D1 stored upon previous correction of the landing positions described above in FIGS. 16 and 17 is read out so that the position of the second carriage 16 relative to the first carriage 15 upon previous correction of the landing positions is set as the reference position of the second carriage 16. At S104, the pulse count D1, that is, the position of the second carriage 16 upon previous correction of the landing positions, and the pulse count D2, that is, the present position of the second carriage 16, are used to calculate an adjustment amount a of the ejection timing changed upon adjustment of the landing positions using a formula of $\alpha$=Pn+(D2−D1).

At S105, whether or not the adjustment amount a is smaller than a preset threshold value B1 is determined in order to check whether or not the first and second carriages 15 and 16 are properly docked with each other.

When the adjustment amount a is equal to or greater than the threshold value B1 (NO at S105), there is a possibility that the first and second carriages 15 and 16 are not properly docked with each other. Therefore, the first and second carriage 15 and 16 are separated from each other at S107, and the process returns to S101 to dock the first and second carriages 15 and 16 with each other again. Before separation of the first and second carriages 15 and 16, at S106 it is determined whether or not the number of times a determination is performed at S105 is equal to or greater than a predetermined number n. Because the image forming apparatus 1 may have a problem when the number of times the determination is performed is equal to or greater than the predetermined number n (YES at S106), the process proceeds to S108 to display an error message reporting a possible malfunction on the operation panel 413 or the like to complete the process.

By contrast, when the adjustment amount a is smaller than the threshold value B1 (YES at S105), the process proceeds to S109 to measure a surrounding temperature T around the first and second carriages 15 and 16 in order to correct the ejection timing depending on environmental conditions.

Thereafter, at S110 whether or not there is a difference between the pulse counts D2 and D1 is determined. When there is no difference between the pulse counts D2 and D1 (YES at S110), the correction amount of the ejection timing does not need to be changed. Therefore, at S111 the ejection timing is changed based only on the surrounding temperature T. By contrast, when there is a difference between the pulse counts D2 and D1 (NO at S110), the process proceeds to S112 to change the ejection timing based on both of the surrounding temperature T and the adjustment amount $\alpha$. Thereafter, the process proceeds to S113 to perform image formation.

It is to be noted that the reference position of the second carriage 16, that is, the pulse count D1, is updated each time the landing positions are corrected using the adjustment pattern 400. In other words, the reference position of the second carriage 16 is stored in association with the correction amount used for correcting the landing positions.

As a result, deterioration in image quality caused by variation in the relative positions of the first and second carriages 15 and 16 due to repeated docking and separation of the first and second carriages 15 and 16 can be prevented.

Figure 19:
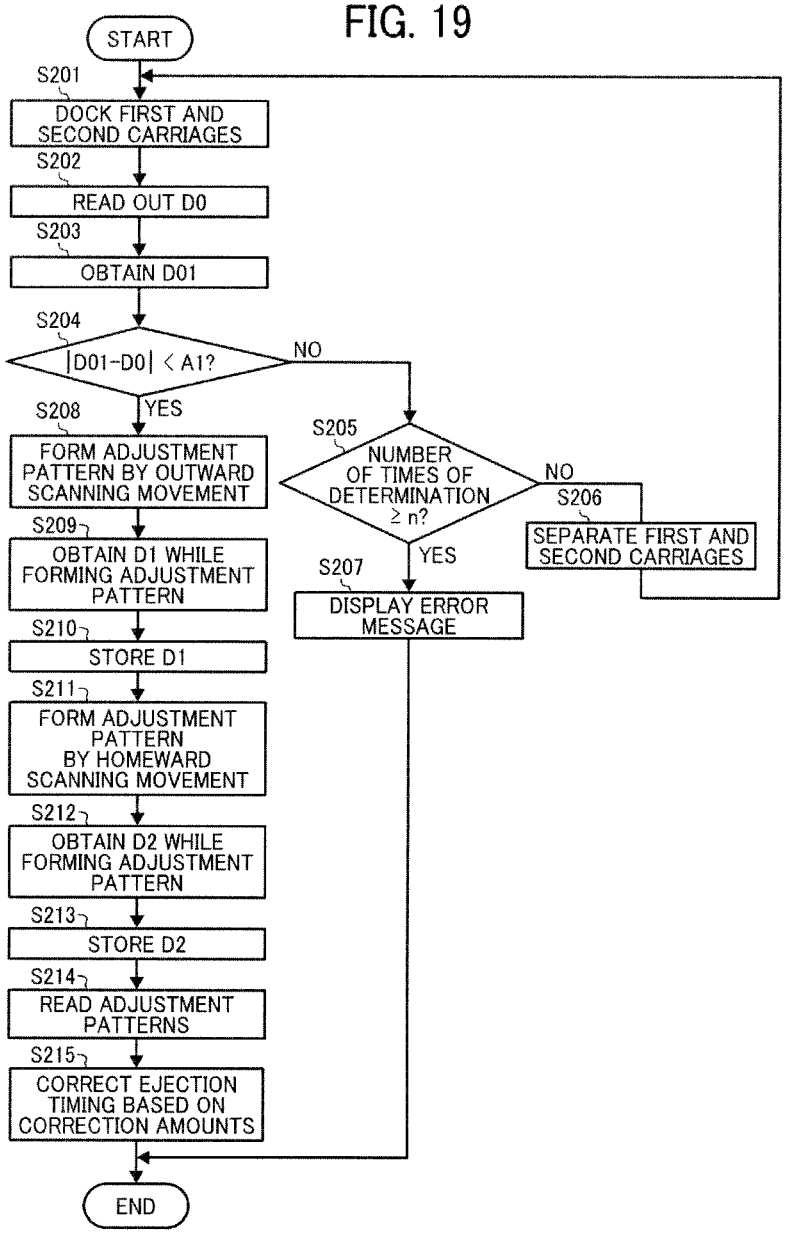
FIG. 19 is a flowchart illustrating steps in a process of automatic adjustment of the landing positions according to a second illustrative embodiment.

A description is now given of automatic adjustment of the landing positions according to a second illustrative embodiment with reference to FIG. 19. FIG. 19 is a flowchart illustrating steps in a process of automatic adjustment of the landing positions according to the second illustrative embodiment.

The differences from the first illustrative embodiment are that the pulse count D2 is separately obtained before the adjustment pattern 400 is formed by outward scanning movement of the first and second carriages 15 and 16 and the pulse counts D1 and D2 are obtained upon each of homeward and outward scanning movement of the first and second carriages 15 and 16 while the adjustment pattern 400 is formed. Because a direction of a force applied to the first and second carriages 15 and 16 is different between outward and homeward scanning movement of the first and second carriages 15 and 16, a distance between the first and second carriages 15 and 16, that is, the position of the second carriage 16 relative to the first carriage 15, may be changed between outward and homeward scanning movement of the first and second carriages 15 and 16.

Also in the second illustrative embodiment, the first and second carriages 15 and 16 are separated from each other at the start of automatic adjustment of the landing positions. Therefore, at step S201, the first and second carriages 15 and 16 are docked with each other. At S202, the default pulse count D0 prestored in the ROM 202 or the like is read out. At S203, a pulse count D01 is obtained from the detection signal output from the position reader 42 when the first and second carriages 15 and 16 are docked with each other. At S204, it is determined that whether or not a difference between the pulse counts D01 and D0 (D01−D0) is smaller than the preset threshold value A1.

When the difference between the pulse counts D01 and D0 is not smaller than the threshold value A1 (NO at S204), there is a possibility that the first and second carriages 15 and 16 are not properly docked with each other. Therefore, the first and second carriage 15 and 16 are separated from each other at S206, and the process returns to S201 to dock the first and second carriages 15 and 16 with each other again. Before separation of the first and second carriages 15 and 16, at S205 it is determined whether or not the number of times a determination is performed at S204 is equal to or greater than the predetermined number n. Because the image forming apparatus 1 may have a problem when the number of times the determination is performed is equal to or greater than the predetermined number n (YES at S205), the process proceeds to S207 to display an error message reporting a possible malfunction on the operation panel 413 or the like to complete the process.

By contrast, when the difference between the pulse counts D01 and D0 is smaller than the threshold value A1 (YES at S204), the process proceeds to S208 to form the adjustment pattern 400 by outward scanning movement of the first and second carriages 15 and 16. At S209, the pulse count D1 is obtained while the adjustment pattern 400 is formed by outward scanning movement of the first and second carriages 15 and 16. The pulse count D1 thus obtained is stored at S210.

Next, at S211, the adjustment pattern 400 is formed by homeward scanning movement of the first and second carriages 15 and 16. At S212, the pulse count D2 is obtained while the adjustment pattern 400 is formed by homeward scanning movement of the first and second carriages 15 and 16. The pulse count D2 thus obtained is stored at S213. At S214, the pattern detector 401 reads each of the adjustment patterns 400 respectively formed by outward and homeward scanning movement of the first and second carriages 15 and 16 to obtain the correction amounts for outward and homeward scanning movement. Thereafter, at S215, the ejection timing is corrected based on each of the correction amounts for outward and homeward scanning movement.

Figure 20A:
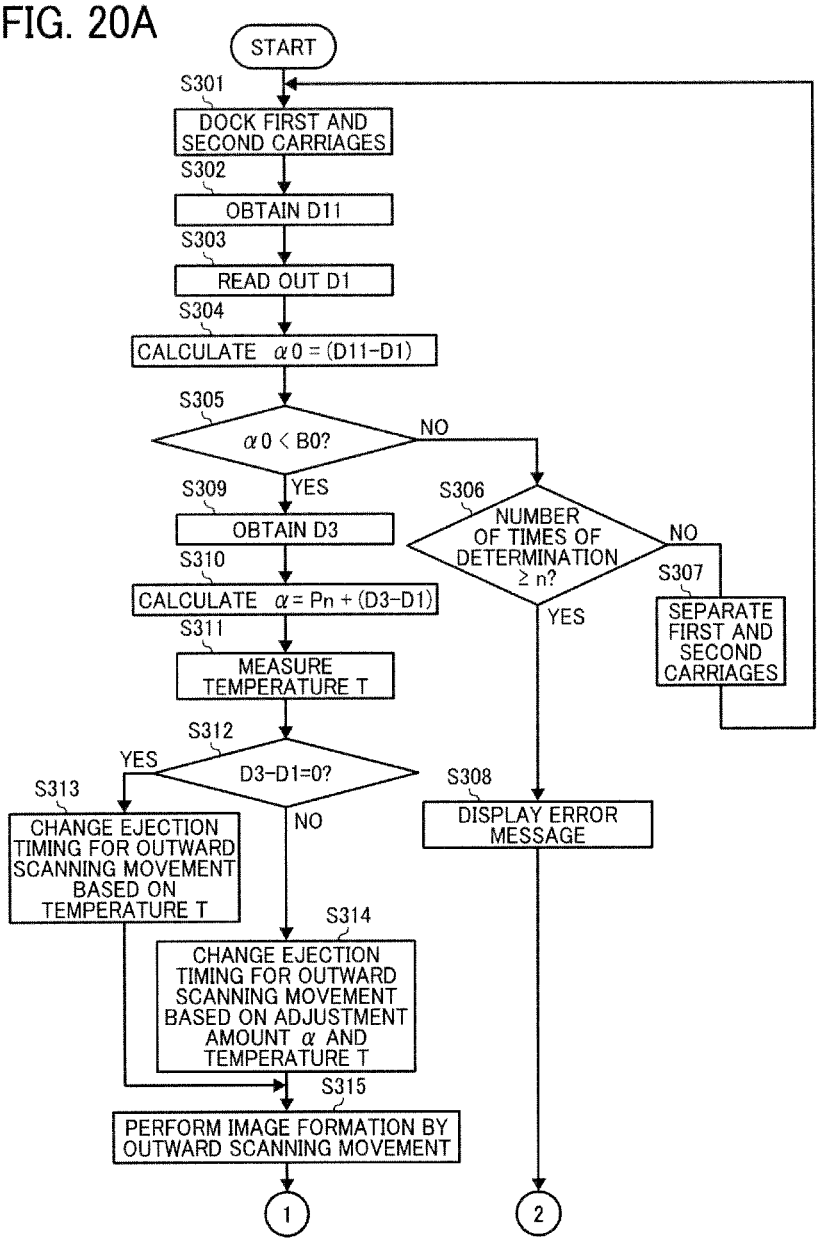
FIGS. 20A and 20B are flowcharts illustrating steps in a process of changing the correction amount of the landing positions during full-color image formation according to the second illustrative embodiment.
Figure 20B:
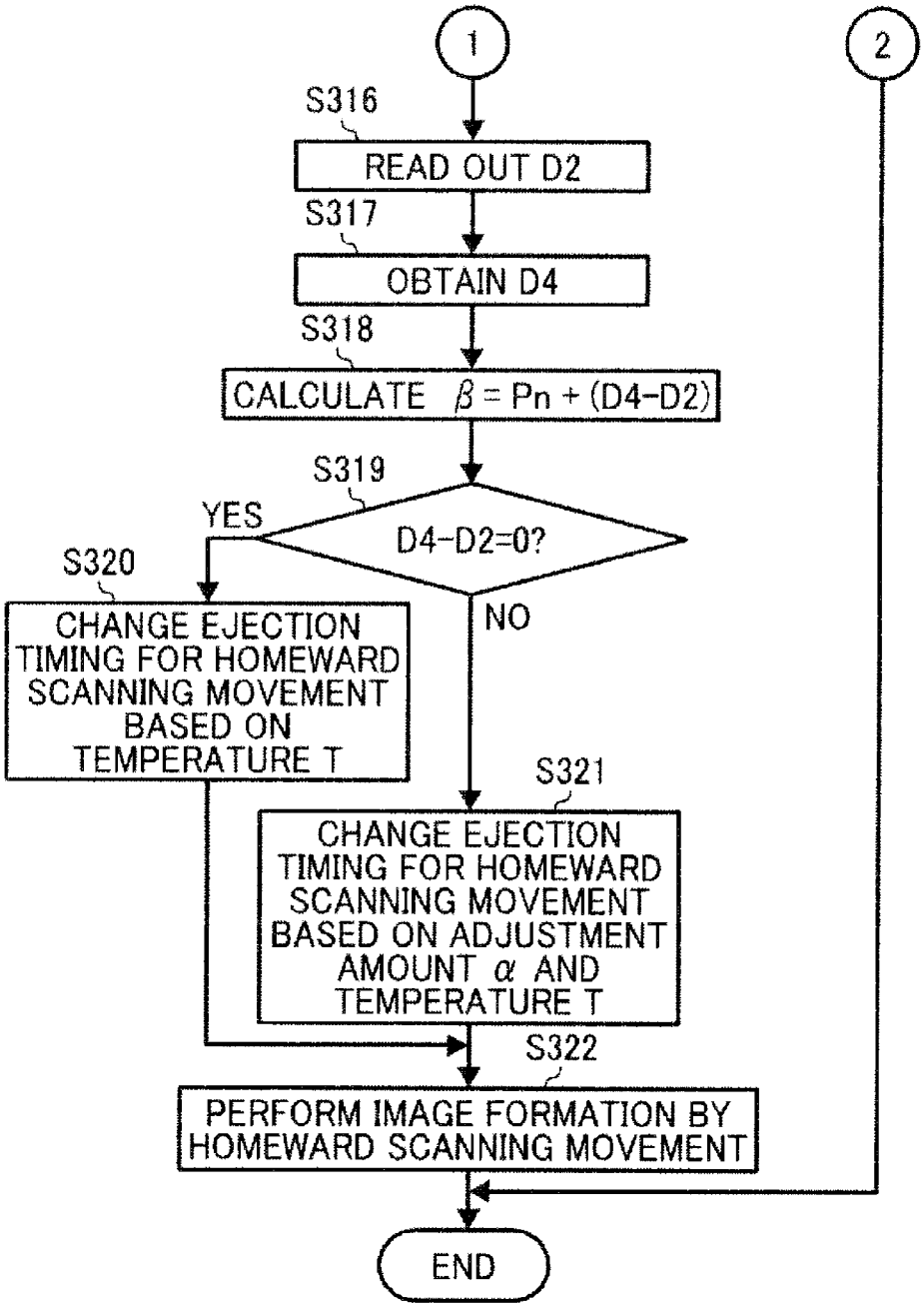

A description is now given of changing of the correction amount of the landing positions during full-color image formation according to the second illustrative embodiment with reference to FIGS. 20A and 20B. FIGS. 20A and 20B are flowcharts illustrating steps in a process of changing the correction amount of the landing positions during full-color image formation according to the second illustrative embodiment.

The first and second carriages 15 and 16 are separated from each other at the start of the operation. Therefore, at step S301, the first and second carriages 15 and 16 are docked with each other. At S302, a pulse count D11 is obtained from the detection signal output from the position reader 42 during docking of the first and second carriages 15 and 16. At S303, the pulse count D1 stored upon previous correction of the landing positions is read out so that the position of the second carriage 16 relative to the first carriage 15 upon previous correction of the landing positions is set as a reference position of the second carriage 16. At S304, the pulse count D1, that is, the position of the second carriage 16 upon previous correction of the landing positions, and the pulse count D11, that is, the present position of the second carriage 16, are used to calculate an adjustment amount $\alpha 0$ of the ejection timing changed upon adjustment using a formula of $\alpha 0=(D11-D1)$.

At S305, whether or not the adjustment amount $\alpha 0$ is smaller than a preset threshold value B0 is determined in order to check whether or not the first and second carriages 15 and 16 are properly docked with each other. When the adjustment amount $\alpha 0$ is equal to or greater than the threshold value B0 (NO at S305), there is a possibility that the first and second carriages 15 and 16 are not properly docked with each other. Therefore, the first and second carriage 15 and 16 are separated from each other at S307, and the process returns to S301 to dock the first and second carriages 15 and 16 with each other again. Before separation of the first and second carriages 15 and 16, at S306 it is determined whether or not the number of times a determination is performed at S305 is equal to or greater than a predetermined number n. Because the image forming apparatus 1 may have a problem when the number of times the determination is performed is equal to or greater than the predetermined number n (YES at S306), the process proceeds to S308 to display an error message reporting a possible malfunction on the operation panel 413 or the like to complete the process.

By contrast, when the adjustment amount $\alpha 0$ is smaller than the threshold value B0 (YES at S305), the process proceeds to S309 to obtain a pulse count D3, that is, the position of the second carriage 16 relative to the first carriage 15, after the scanning speed of the first and second carriages 15 and 16 docked with each other is accelerated to a predetermined speed.

At S310, the pulse count D1, that is, the position of the second carriage 16 upon previous correction of the landing positions during outward scanning movement of the first and second carriages 15 and 16, and the pulse count D3, that is, the present position of the second carriage 16, are used to calculate the adjustment amount a of the ejection timing changed upon adjustment using a formula of $\alpha=Pn+(D3-D1)$. At S311 the surrounding temperature T around the first and second carriages 15 and 16 is measured in order to correct the ejection timing depending on environmental conditions.

Thereafter, at S312 whether or not there is a difference between the pulse counts D3 and D1 is determined. When there is no difference between the pulse counts D3 and D1 (YES at S312), the correction amount of the ejection timing does not need to be changed. Therefore, at S313 the ejection timing for outward scanning movement is changed based only on the surrounding temperature T. By contrast, when there is a difference between the pulse counts D3 and D1 (NO at S312), the process proceeds to S314 to change the ejection timing for outward scanning movement based on both of the surrounding temperature T and the adjustment amount $\alpha$. Then, the process proceeds to S315 to perform image formation by outward scanning movement of the first and second carriages 15 and 16.

After completion of image formation by outward scanning movement of the first and second carriages 15 and 16, the process proceeds to image formation by homeward scanning movement of the first and second carriages 15 and 16. At S316, the pulse count D2, that is, the position of the second carriage 16 upon previous correction of the landing positions during homeward scanning movement of the first and second carriages 15 and 16 is read out. At S317, a pulse count D4, that is, the position of the second carriage 16 relative to the first carriage 15, is obtained after the scanning speed of the first and second carriages 15 and 16 docked with each other is accelerated to a predetermined speed. At S318, the pulse count D2, that is, the position of the second carriage 16 upon previous correction of the landing positions during the homeward scanning movement of the first and second carriages 15 and 16, and the pulse count D4, that is, the present position of the second carriage 16, are used to calculate an adjustment amount $\beta$ of the ejection timing changed upon adjustment using a formula of $\beta=Pn+(D4-D2)$.

Thereafter, at S319 whether or not there is a difference between the pulse counts D4 and D2 is determined. When there is no difference between the pulse counts D4 and D2 (YES at S319), the correction amount of the ejection timing does not need to be changed. Therefore, at S320 the ejection timing for homeward scanning movement of the first and second carriages 15 and 16 is changed based only on the surrounding temperature T. By contrast, when there is a difference between the pulse counts D4 and D2 (NO at S319), the process proceeds to S321 to correct the ejection timing for homeward scanning movement of the first and second carriages 15 and 16 based on both of the surrounding temperature T and the adjustment amount $\beta$. Then, the process proceeds to S322 to perform image formation by homeward scanning movement of the first and second carriages 15 and 16.

As described above, the ejection timing is individually changed at each of outward and homeward scanning movement of the first and second carriages 15 and 16. Accordingly, the landing positions are more accurately corrected, thereby enhancing image quality.

Figure 21:
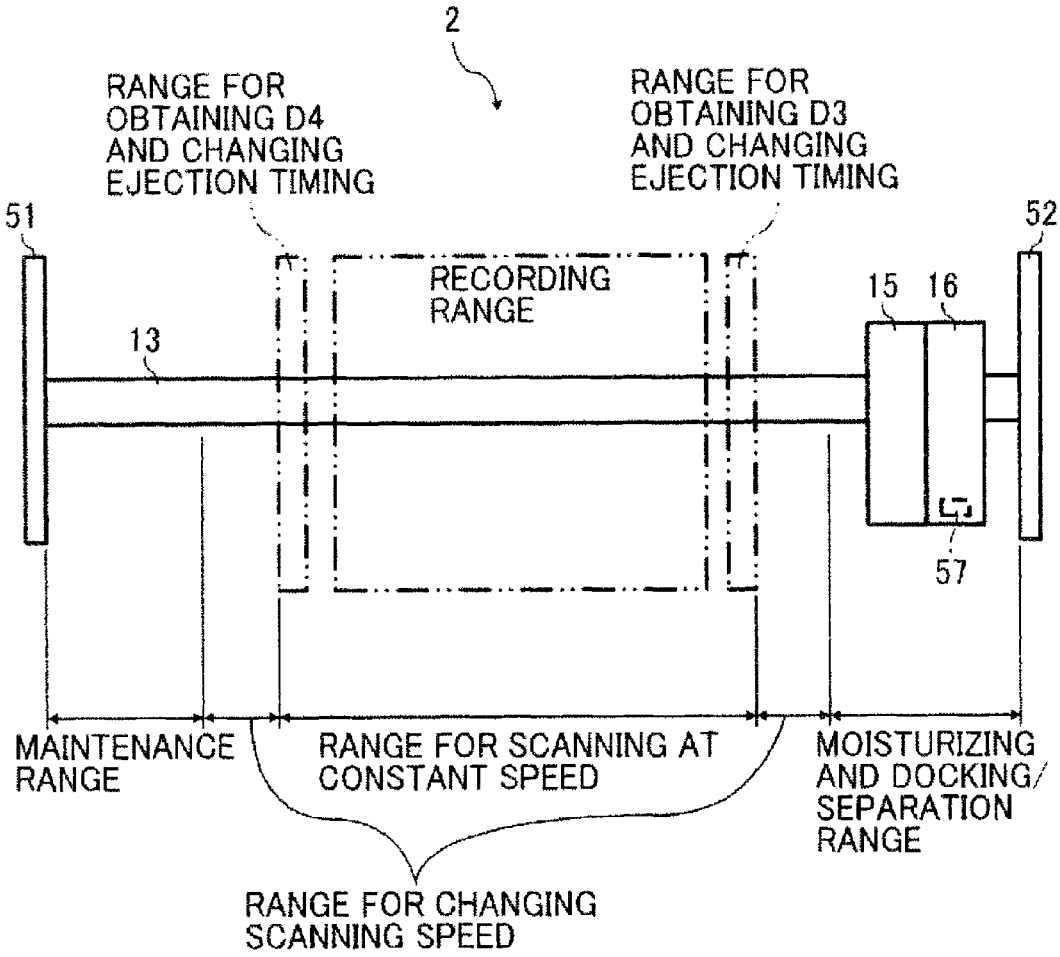
FIG. 21 is a top view illustrating timings of obtaining a position of the second carriage and changing the correction amount of the landing positions according to the second illustrative embodiment.

A description is now given of timings of detecting the position of the second carriage 16 and changing the correction amount of the landing positions according to the second illustrative embodiment with reference to FIG. 21. FIG. 21 is a top view illustrating timings of obtaining the position of the second carriage 16 and changing the correction amount of the landing positions according to the second illustrative embodiment.

Docking and separation of the first and second carriages 15 and 16 are performed at a docking/separation range in FIG. 21 that lies within the scanning range of the first and second carriages 15 and 16. In addition, the maintenance mechanism 18 services and moisturizes the first and second recording heads 101 and 102 using caps 71 and 72 at the docking/separation range within the scanning range of the first and second carriages 15 and 16. Ink droplets are ejected from the first and second recording heads 101 and 102 for maintenance at a maintenance range within the scanning range in FIG. 21.

A middle portion of the scanning range of the first and second carriages 15 and 16 is the recording range. The recording range is encompassed within a range where the first and second carriages 15 and 16 are moved at a constant speed. The range where the first and second carriages 15 and 16 are moved at a constant speed is sandwiched between ranges where scanning speed of the first and second carriages 15 and 16 is accelerated or decelerated. The pulse counts D3 and D4 for each of outward and homeward scanning movement of the first and second carriages 15 and 16 are obtained at the ranges where the first and second carriages 15 and 16 are moved at the constant speed outside the recording range to change the ejection timing. As a result, the pulse counts D3 and D4 are obtained while the relative positions of the first and second carriages 15 and 16 are stabilized, thereby more reliably correcting the landing positions.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2010-032932, filed on Feb. 17, 2010 in the Japan Patent Office, which is hereby incorporated herein by reference in its entirety.

What is claimed is:

1. An image forming apparatus comprising:

a first carriage having a first recording head to eject black liquid droplets and movable in a main scanning direction;

a second carriage having a second recording head to eject color liquid droplets and separatably dockable with the first carriage;

a position detector comprising a positional reference marker provided to the first carriage and a position reader provided to the second carriage to read the positional reference marker, the position detector detecting a position of the second carriage relative to the first carriage in a state in which the first and second carriages are docked with each other; and a landing position corrector to correct landing positions of liquid droplets ejected from at least one of the first and second recording heads, the landing position corrector holding the position, obtained by the position detector upon correction of the landing positions, of the second carriage relative to the first carriage, as a reference position of the second carriage and adjusting a correction amount for correcting the landing positions based on an amount of shift between the reference position and a present position of the second carriage relative to the first carriage docked with the second carriage for image formation.

2. The image forming apparatus according to claim 1, further comprising:

a pattern forming unit to form on a recording medium an adjustment pattern for correcting a shift in the landing positions; and a pattern reader to read the adjustment pattern, wherein the landing position corrector corrects the landing positions based on a result obtained by the pattern reader.

3. The image forming apparatus according to claim 1, further comprising a pattern forming unit to form on a recording medium an adjustment pattern for correcting a shift in the landing positions, wherein the landing position corrector corrects the landing positions based on data associated with the correction amount corresponding to the adjustment pattern.

4. The image forming apparatus according to claim 1, wherein the landing position corrector adjusts the correction amount depending on the amount of shift each time the first and second carriages are docked with each other.

5. The image forming apparatus according to claim 1, wherein the first and second carriages are separated from each other to repeat docking of the first and second carriages again when the amount of shift is equal to or greater than a predetermined amount upon docking of the first and second carriages.

6. The image forming apparatus according to claim 1, wherein the landing position corrector holds the reference position of the second carriage for each of outward and homeward scanning movement of the first and second carriages to adjust the correction amount for each of outward and homeward scanning movement of the first and second carriages.

7. The image forming apparatus according to claim 1, wherein the landing position corrector obtains the position of the second carriage detected by the position detector after acceleration of scanning speed of the first and second carriages docked with each other is completed.

8. The image forming apparatus according to claim 1, wherein the reference position of the second carriage is revised to a corrected position of the second carriage each time the landing positions are corrected.

9. A method for correcting landing positions of liquid droplets ejected from at least one of first and second recording heads respectively mounted on first and second carriages and separatably dockable with each other, the method comprising the steps of:

(a) detecting a position of the second carriage relative to the first carriage in a state in which the first and second carriages are docked with each other;

(b) holding the position, obtained in (a) upon correction of the landing positions, of the second carriage relative to the first carriage, as a reference position of the second carriage;

(c) adjusting a correction amount for correcting the landing positions based on an amount of shift between the reference position and a present position of the second carriage relative to the first carriage docked with the second carriage for image formation; and (d) correcting the landing positions based on the correction amount.

* * * * *